US006204874B1

(12) United States Patent
Michelson

(10) Patent No.: US 6,204,874 B1
(45) Date of Patent: Mar. 20, 2001

(54) THERMAL PLATESETTER AND COLOR PROOFER

(75) Inventor: Amos Michelson, Vancouver (CA)

(73) Assignee: Creo Products Inc., Burnaby (CA)

( * ) Notice: Subject to any disclaimer, the term of this patent is extended or adjusted under 35 U.S.C. 154(b) by 0 days.

(21) Appl. No.: 09/076,172

(22) Filed: May 7, 1998

(51) Int. Cl.[7] ..... B41J 2/325
(52) U.S. Cl. ..... 347/176
(58) Field of Search ..... 346/138; 347/172, 347/174, 176, 224; 400/120.01, 120.02, 120.04

(56) References Cited

U.S. PATENT DOCUMENTS 5,276,464 * 1/1994 Kerr et al. ..... 346/134
5,280,307 * 1/1994 Parsons ..... 347/176
5,341,159 * 8/1994 Kerr ..... 347/176
5,436,695 * 7/1995 Lucking et al. ..... 346/138
5,699,099 * 12/1997 Garand et al. ..... 347/172
5,734,408 * 3/1998 Rombult et al. ..... 347/224
5,734,409 * 3/1998 Rombult et al. ..... 347/224
5,852,464 * 12/1998 Hebert et al. ..... 347/224

FOREIGN PATENT DOCUMENTS 0 402 079 A2 * 6/1990 (JP) .

* cited by examiner

*Primary Examiner*—Huan Tran
(74) *Attorney, Agent, or Firm*—Oyen Wiggs Green & Mutala

(57) ABSTRACT

A device can expose both lithographic printing plates and color proofing materials using the same thermal exposure head. The color proofer mode uses four or more donor sheets and transfers a dye onto a receiver sheet. In order to automate the process, the donor sheets are packaged in a box containing the different donor sheets and receiver sheets in the order they are used by the proofer. The proofer picks up the sheets using a vacuum supply and exposes them.

20 Claims, 3 Drawing Sheets

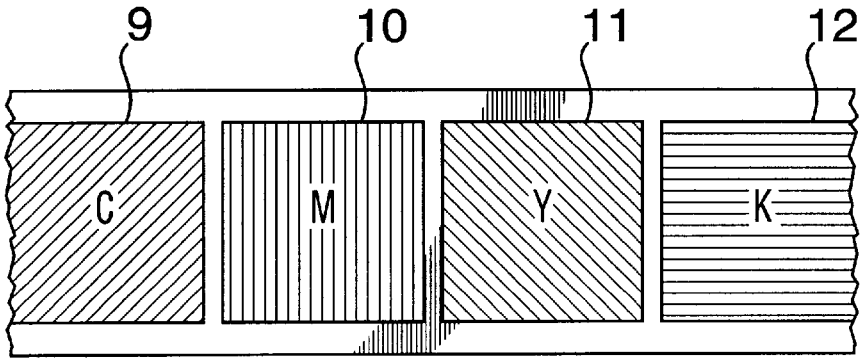
FIG. 1-a
PRIOR ART
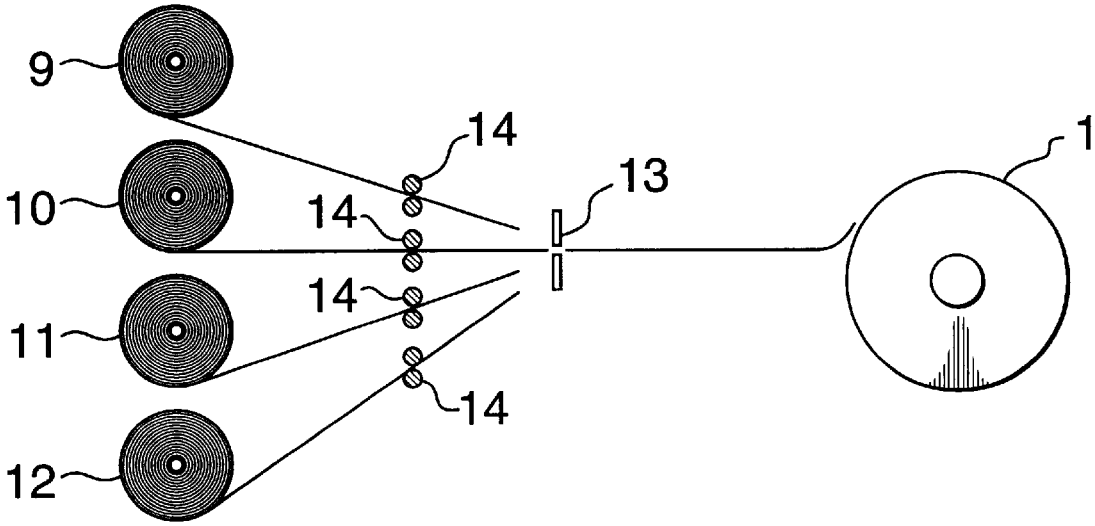
FIG. 1-b
PRIOR ART

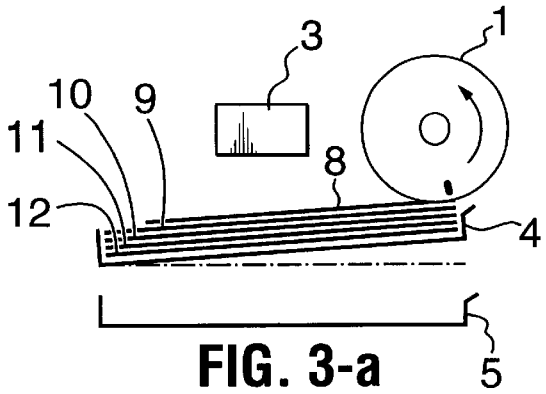
FIG. 3-a
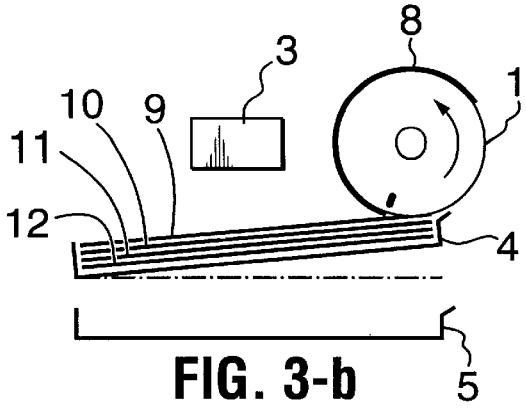
FIG. 3-b
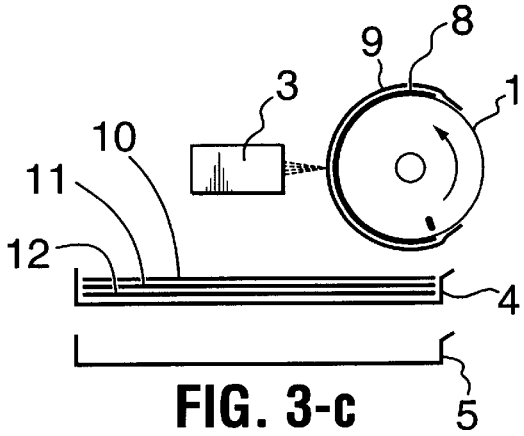
FIG. 3-c
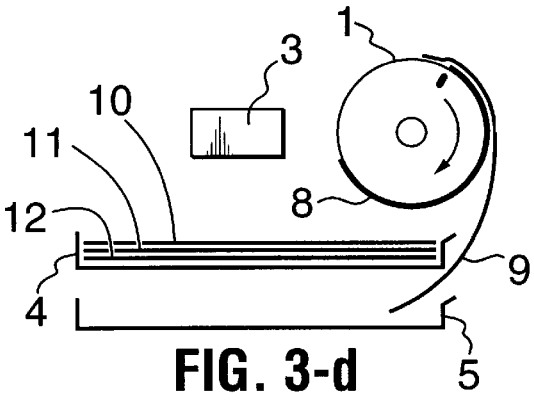
FIG. 3-d
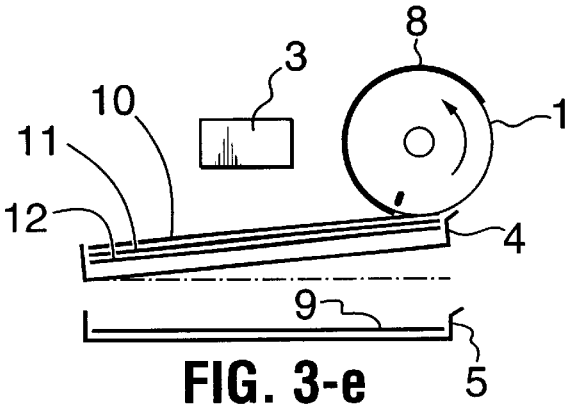
FIG. 3-e
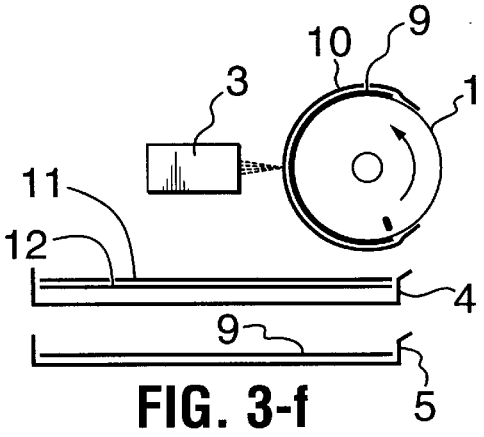
FIG. 3-f

THERMAL PLATESETTER AND COLOR PROOFER

FIELD OF THE INVENTION

The invention relates to printing and mo re specifically to platemaking and color proofing, which are pre-press steps in printing.

BACKGOUND OF THE INVENTION

As the printing industry is moving to Computer-to-Plate systems, new methods of digital color proofing are needed to replace the traditional film based proofing. Computer-to-Plate, or CTP, refers to directly imaging printing plates. Color proofers are used to generate a composite color image representative of the output of a color printing press. A common type of color proofers is the thermal transfer type, wherein a dye or pigment is transferred from a donor sheet to a receiver sheet by heating the dye or pigment. The heating can be accomplished by resistive type electrical heaters or by a focused beam of a laser, typically an infra-red laser. This type of system performs "thermal" or "heatmode" imaging. In operation, the receiver sheet, which can be paper or an intermediate receiver, is held on a rotating drum while four or more donor sheets of different colors are placed, one at a time, over the receiver sheet and the color transferred from the donor sheets to selected areas of the receiver sheet. This is followed by applying a protective coating on the receiver sheet or lamination of the intermediate receiver to paper stock. The most well known system of this type is the KODAK APPROVAL™ system, manufactured by Kodak Co. (Rochester, N.Y.).

In order to automate the of creating a proof process prior art proofers use primarily two methods, shown in FIG. 1-*a* and FIG. 1-*b*. For small format proofers, such as dye sublimation proofers, the four donor sheets are coated on a common substrate supplied in roll form. A typical appearance of such a composite donor roll is shown in FIG. 1-*a,* where the Cyan, Yellow, Magenta and Black pages appear in sequence throughout the roll. For larger formats each donor is supplied on an individual roll, as shown in FIG. 1-*b*. To load the donors from the rolls onto a drum, feed rollers (item 14 in FIG. 1-*b*) and a cutter (item 13 in FIG. 1-*b*) are used. There are disadvantages in these two prior art systems, the main one being the difficulty of using special colors, other than the standard Red, Green, Blue or Cyan, Yellow, Magenta, Black. From time to time the need arises to add a special color (such as gold or silver) to a single proof. The roll feed system eliminates the flexibility of a sheet fed system to quickly change the colors or sizes of the donor sheets. A second disadvantage of roll fed system is the lower manufacturing yield of the donors, as a single defective sheet in the roll will cause the complete roll to be scrapped instead of simply scrapping the defective sheet. Another disadvantage of the system shown in FIG. 1-*b* is the large space taken by the donor rolls. A further disadvantage of the system of FIG. 1*b* is that the system is dedicated for proofing, requiring a separate machine for plate exposure. In theory it would have been possible to generate proofs and plates on a single prior art thermal unit, however, the required manual loading of each sheet separately made the process unproductive, as each proof would have required at least 10 steps (one receiver and at least four donors, each one having to be loaded and unloaded).

Another type of prior art system is disclosed in European Patent Application EP0402079 and uses electrophotographic recording to produce proofs and plates from the same units.

Electrographic plates were not successful due to poor resolution and short life, while the color toners required for the electrophotographic proofs were difficult to change for special colors. Other colors, such as metallic tones, are not possible using this process as the toner has to be an electrical insulator. A different approach, by Optronics (Chelmsford, Mass.) uses an imager with color lasers to make plates and uses photographic paper for proofs. This system has not been not successful as the photographic film requires complex processing and does not allow any special colors (since colors have to be built into the photographic paper emulsion).

SUMMARY OF THE INVENTION

It is an object of this invention to provide a single device capable of automatically loading printing plates and proofing sheets onto the same drum and using a single laser head to expose both. This generates the best match between the plate and the proof, and consequently the best match between the printed material and the proof. A second object of this invention to have the flexibility of sheet fed system with the automation previously only available in roll fed proofers, particularly the flexibility of changing proof size and adding special colors. A third object is to build a compact, low cost proofs. A further object is to lower cost of proofer and proofing materials by the inherent yield advantages of cut sheet. Still a further object is to provide a system which does not require any chemical processing for plates or proofing.

The invention combines a Computer-to-Plate system using a thermal imaging head with a thermal proofer. The invention uses a color proofer of conventional design, the innovation involving to combining both units into a single machine and automating the loading process of proofs using a sheet feeding tray. In this tray the materials are stacked in the same order the proofer is using them: a receiver sheet followed by four different donor sheets, this sequence being repeated many times. As in prior art, the donor sheets are larger than the receiver sheet, to allow the vacuum around the receiver sheet to hold the donor sheets. Means of loading the sheets onto the drum are provided, preferably a hinged tray, in order to bring the sheets into contact with the drum, allowing the drum to grip a sheet from the tray using the vacuum holes in the drum. The discarded donor sheets are unloaded into a second tray. The sequencing of the sheets in the tray can be done by pre-packing them by the supplier in the correct sequence or by the user of the color proofer. This allows the easy addition of customized colors and replacement of sheets with different colors. The printing plate can be loaded in the same tray as the proofing materials or have a separate loading means.

BRIEF DESCRIPTION OF THE DRAWINGS

FIG. 1-*a* to FIG. 1-*b* are schematic representations of the prior art.

FIG. 3 to FIG. 3-*f* illustrate a sequence of steps involved in using the present invention.

DESCRIPTION OF THE PREFERRED EMBODIMENT

Figure 2:
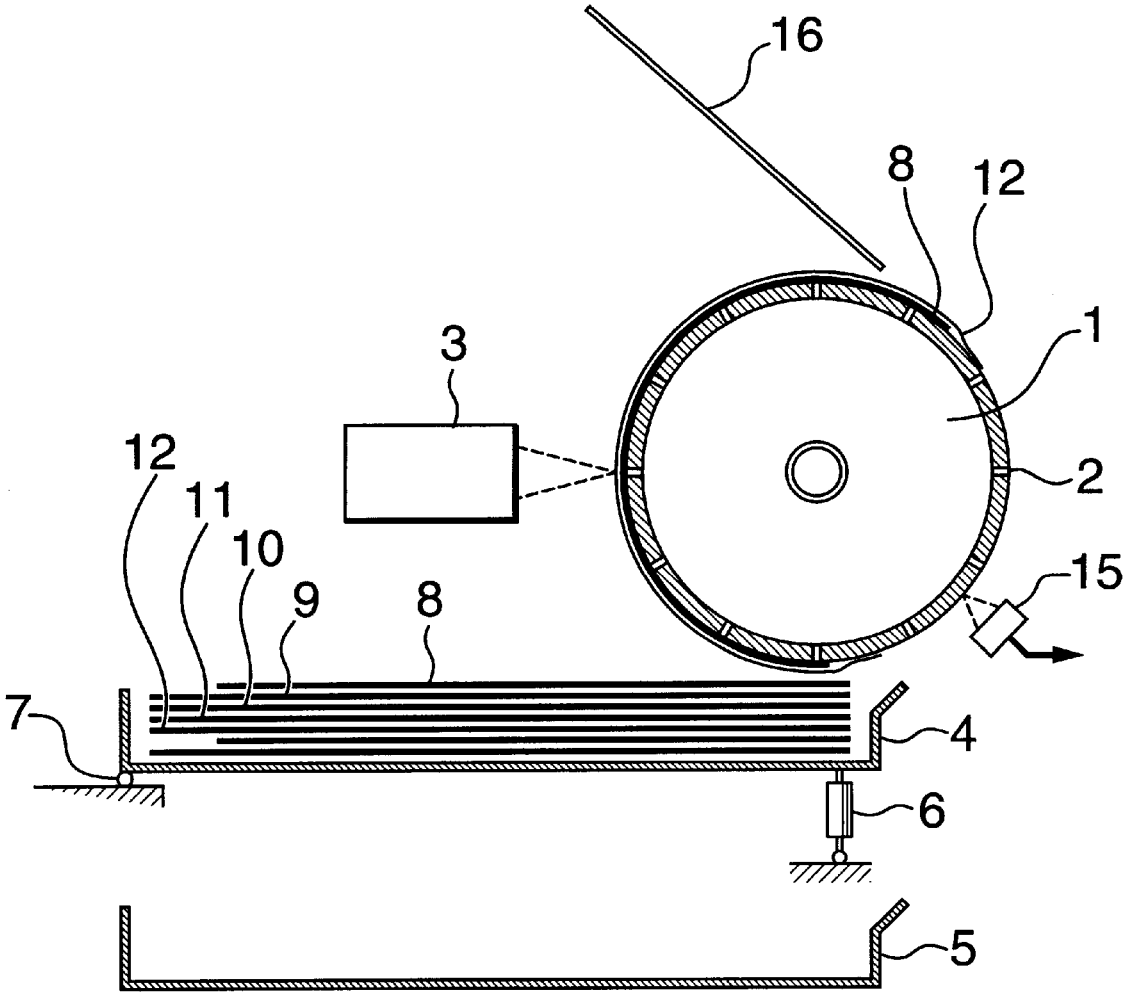
FIG. 2 is a schematic cross section of a combined platesetter and color proofer according to the present invention.

The preferred embodiment uses an external drum exposure unit and a thermal exposure head. The term "thermal" refers to the fact that the marking is performed by heat, which may be created using a laser, rather than a photonic reaction. An exposure unit of the external drum type is shown in a schematic cross section in FIG. 2. All items not related to the invention are deleted for clarity. An example of a thermal imaging unit is a TRENDSETTER™ platesetter manufactured by Creo Products Inc. (Burnaby, B.C., Canada) or the APPROVAL digital proofer manufactured by the Kodak Co. (Rochester, N.Y.). The difference between the Approval and the present invention is the sheet feeding systems (Approval uses roll feed) and the ability to image printing plates.

Referring now to FIG. 2, drum 1 has vacuum holes 2 and is connected to a vacuum pump (not shown). A receiver sheet 8 is shown on the drum covered by a donor sheet 12. In all the figures four donor sheets 9, 10, 11, 12 are shown. By the way of example these can correspond to the Cyan, Yellow, Magenta and Black donors. The invention is not limited to four sheets: any combination of donors can be used. The dye or pigment is transferred from donor sheet 12 (on the drum) to receiver 8 (on the drum) by the action of a focused laser beam from writing head 3. Multiple sets of ordered donor sheets and receiver sheets can be stored in tray 4. Tray 4 can be moved towards drum 1 by actuator 6 and pivot 7. Many alternatives, such as the use of two actuators or moving drum 1 instead of tray 4 can be used. A second tray 5 is used to receive the used-up sheets and the finished proof. The invention is not limited to two trays: any number of trays can be used, some for proofs and others for plates or films. The essence of the invention is in loading tray 4 with pre-sequenced sets of donors and receivers, thus allowing the production of multiple proofs in an automated fashion as well as the production of printing plates. Since each donor is of a different color and all of them differ from the color of the receiver, it is easy to detect any loading error by using a color sensitive detector 15. Such color sensitive detectors are commercially available, for example from the Keyence Co. (Japan). The receiver sheet is white (paper) or transparent (if an intermediate sheet, to be laminated to paper, is used). In order to use the system for imaging printing plates, the plates can be placed on the same tray 4 as the proofing materials or use a separate tray or loading ramp 16. Methods of loading plates onto drums are well known and need not be detailed here.

Referring now to FIG. 3-*a* through FIG. 3-*f*, the steps in operating the color proofer are shown. Operation starts by loading a receiver sheet onto the drum, shown in FIG. 3-*a* Tray 4 is tipped to touch the drum allowing the drum to pick up sheet 8 by the action of the vacuum holes. The drum is rotated to wrap the sheet as shown in FIG. 3-*b*. In FIG. 3-*b* tray 4 is tipped toward the drum again and the first donor sheet is picked up by the vacuum holes and wrapped onto the drum. Since some receiver sheets are not permeable to vacuum, the donor sheets should extend beyond the receiver sheet by a small amount (1–2 cm) to allow the vacuum to grip them. This is done by making donor sheets wider than receiver sheets and loading each of the donor sheets with is leading edge at a slightly different position on the drum from the leading edge of the receiver sheet (compare drum position in FIG. 3-*b* to FIG. 3-*a*). After loading, the first color is imaged, as shown in FIG. 3-*c*. After imaging vacuum is partially released, causing donor sheet 9 in FIG. 3-*d* to come off the drum while receiver sheet 8 stays on the drum, as it is held over a much larger area. Discarded sheet 9 is unloaded into second tray 5 by reversing rotation of the drum. The second donor sheet is loaded as shown in FIG. 3-*e*, in a similar manner to the loading of the first sheet. FIG. 3-*f* shows the imaging of the second color. The sequence continues until all donor sheets for this proof are used. The number of donor sheets is typically four but special colors can be added into the tray in any order. It is not uncommon to print with six or even eight colors, requiring the same number of donor sheets. After last donor is imaged and released, vacuum is fully released to unload the receiver sheet 8 into tray 5 or into a separate unloading tray (not shown).

The groups of donor sheets and receivers can be pre-packaged in a box, with a large number of sets in each box, typically from 10 to 50 sets. Unloading such a box into tray 4 allows many hours of fully automated operation while retaining the flexibility of inserting a custom color or even a non-proofing material, such as a sheet of thermal film or plate, into the stack. At any time in the process a printed plate can be imaged without changing the configuration of the device, as long as the drum is free from proofing materials. If the printing plate has a non-metal substrate it can be handled like a proofing sheet. This is particularly important for some of the newer thermal plates, not requiring any chemical processing, as they are polyester based.

While the preferred embodiment is of the "external drum" type, where material is loaded on the outside of a drum, the invention applies to loading materials on any cylinder surface, including loading the material on the inside of the drum, an embodiment known as an "internal drum" type.

What is claimed is:

1. A thermal imaging system capable of exposing both printing plates and color proofing material, the system comprising:

a thermal exposure head for exposing both printing plates and color proofing material; and, means for automatically loading proofing material, in sheet form, from a tray holding a plurality of stacked sheets of proofing material onto a cylindrical surface, the proofing material comprising a receiver sheet and a plurality of donor sheets, the means for automatic loading including provisions for easily changing any one or more of the number, order and size of the proofing material sheets.

2. A thermal imaging system as in claim 1 wherein the printing plates comprise lithographic printing plates.

3. A thermal imaging system as in claim 1 wherein the printing plates comprise processless thermal lithographic printing plates.

4. A thermal imaging system as in claim 1 wherein the proofing material and the printing plates use the same loading means.

5. A thermal imaging system as in claim 1 wherein the proofing material and the printing plates use different loading means.

6. A thermal imaging system as in claim 1 wherein said cylindrical surface is in the form of a drum, said proofing material being loaded on the outside of the drum.

7. A thermal imaging system as in claim 1 wherein said cylindrical surface is on the inside of a drum.

8. A thermal imaging method comprising:

a) preparing a color proof by:

i) loading a receiver sheet onto a cylindrical surface;

ii) while the receiver sheet is on the cylindrical surface automatically loading a first color proofing material donor sheet onto the cylindrical surface;

iii) transferring a colorant from the donor sheet onto the receiver sheet by heating the donor sheet with a thermal exposure head;

iv) automatically unloading the donor sheet from the cylindrical surface;

v) repeating the steps (b), (c) and (d) for at least a second donor sheet;

vi) unloading the receiver sheet; and, b) either before or after preparing the color proof, imaging a printing plate by:

i) loading a printing plate onto the cylindrical surface; and, ii) exposing the printing plate with the thermal exposure head wherein, prior to loading, the donor sheets are stacked, in sequence, in a tray which is accessible so that one can readily change the number, order and size of the donor sheets.

9. The method of claim 8 wherein, prior to loading, the receiver sheet is stacked in the tray.

10. The method of claim 8 wherein, prior to loading, the printing plate is stacked in the tray.

11. The method of claim 8 comprising providing multiple sets of ordered donor sheets in the tray.

12. The method of claim 8 wherein loading the donor sheets is performed with a loading means and loading the printing plate is performed with the same loading means.

13. The method of claim 12 wherein the printing plate comprises a processless thermal lithographic printing plate.

14. The method of claim 8 wherein the thermal exposure head comprises a focused laser beam, heating the donor sheet comprises illuminating the donor sheet with the laser beam and exposing the printing plate comprises illuminating the printing plate with the laser beam.

15. The method of claim 8 wherein the printing plate comprises a lithographic printing plate.

16. The method of claim 8 wherein the cylindrical surface is an outer surface of a drum.

17. The method of claim 8 wherein the cylindrical surface is an inner cylindrical surface.

18. The method of claim 8 wherein the printing plate comprises a processless thermal lithographic printing plate.

19. A combined color proofing and platesetting system comprising:

a) a cylindrical surface for supporting a sheet of material to be imaged;

b) a thermal imaging head capable of exposing both printing plates and color proofing materials located on the surface;

c) a loading system comprising an area for accommodating a stack of proofing materials, the proofing materials comprising a plurality of donor sheets stacked in sequence, and an automatic control for causing sheets from the stack to be loaded onto the surface, wherein the area is accessible to permit the number, order and size of the proofing material sheets to be changed.

20. The combined color proofing and platesetting system of claim 19 wherein the automatic control is configured to automatically load a receiver sheet from the stack onto the cylindrical surface, to sequentially load and unload a plurality of donor sheets from the stack onto the surface overlying the receiver sheet, and then to unload the receiver sheet from the surface.

* * * * *